US006213046B1

(12) United States Patent
Lawson

(10) Patent No.: US 6,213,046 B1
(45) Date of Patent: Apr. 10, 2001

(54) WATERCRAFT COVER

(76) Inventor: Kenneth Lawson, 7109 Skyview Rd., Riverside, CA (US) 92509

( * ) Notice: Subject to any disclaimer, the term of this patent is extended or adjusted under 35 U.S.C. 154(b) by 0 days.

(21) Appl. No.: 09/625,224

(22) Filed: Jul. 24, 2000

(51) Int. Cl.[7] ..... B63B 17/00
(52) U.S. Cl. ..... 114/361; 150/166; 296/136
(58) Field of Search ..... 114/361; 280/414.1; 296/157, 136; 150/166

(56) References Cited

U.S. PATENT DOCUMENTS

| | | | | |
|---|---|---|---|---|
| 4,223,414 | * | 9/1980 | Dickson | 114/361 |
| 4,934,302 | | 6/1990 | Harper | 114/361 |
| 5,058,946 | | 10/1991 | Faber | 296/181 |
| 5,119,752 | | 6/1992 | Doherty | 114/361 |
| 5,632,223 | | 5/1997 | Bray et al. | 114/361 |
| 5,997,071 | * | 12/1999 | Mazzarelli | 150/166 |
| 6,125,784 | * | 10/2000 | Rehel et al. | 114/361 |

* cited by examiner

*Primary Examiner*—Jesus D. Sotelo
(74) *Attorney, Agent, or Firm*—Edgar W. Averill, Jr.

(57) ABSTRACT

A removable protective cover for watercraft having a rigid upper shell which contours the upper portion of the watercraft. The rigid upper shell has a peripheral flange which rests on the watercraft, particularly on a rub rail surrounding the hull of the watercraft. An overhanging hitch is connected to a nose end of the protective cover and contours to the bow 12. By seating the bow in the hitching cavity, the nose end of the protective cover is releasably secured to the bow. Furthermore, the protective cover has an aperture at the tail end which is used to secure the tail end to the stern upon first seating the bow.

13 Claims, 3 Drawing Sheets

WATERCRAFT COVER

BACKGROUND OF THE INVENTION

The field of the invention pertains to protective covers. The invention relates more particularly to a removable protective cover for watercraft, wherein a peripheral flange of the upper shell is supported by a rub rail of said watercraft. Furthermore, a hitching element is utilized to secure the protective cover to the watercraft.

The popularity of personal watercraft has increased in recent years for use in recreational activities, including pleasure boating and waterskiing. However, because of the open top construction of most personal watercraft, the watercraft is exposed to harsh environmental conditions which can damage the open top. Moreover, unauthorized entry into the watercraft is possible due to its open top construction. In an effort to address these concerns, various types of protective covers have been developed and utilized, both as a protective device and as a security measure. For instance, weather-resistant, flexible covers have been used mainly to provide protection from the elements. As can be seen in U.S. Pat. No. 5,632,223, a protective covering system is shown having a strap which is connected to the body of a watercraft, and a universal clip being attached to the strap. However, one of the disadvantages to having a flexible watercraft covering is that they provide little security for boats and their contents. The fabric of flexible covers may be easily breached. Moreover, a flexible cover has a tendency to flutter during transportation of the watercraft, which can cause tears in the flexible cover.

In an effort to address the inadequacies of a flexible cover, various rigid, hard-case covers have been developed. For example, as can be seen in U.S. Pat. No. 4,934,302, a rigid cover is shown hydraulically mounted on a mobile trailer unit at a front end and at its sides, without contacting the exterior of the boat. Hydraulically activated cylinders on the side of the mobile trailer function to raise and lower the cover by pivoting the cover about its front end. Additionally, as can be seen in U.S. Pat. No. 5,058,946, another rigid hinged cover is shown, hingedly mounted to a mobile trailer. Similar to the cover in the '302 patent, the cover in the '946 patent also has a pair of jack assemblies along the sides of the cover and trailer to raise and lower the cover. In both the '302 and '946 patents, the protective covers are permanently secured to the trailer units, with mechanical actuation systems functioning to raise and lower the covers. While both of these cover systems may suitably effect its purpose, they require complex and costly actuation motors and structures. Moreover, because these covers need to be propped up about the bow of the boat when accessing the seated watercraft, the raised cover is vulnerable to gusts of wind which can cause substantial damage.

As can be seen in U.S. Pat. No. 5,119,752, a personal motorcraft trailer is shown having a lower shell which is capable of floatation, and an upper shell which fits over the edge of the lower shell, thereby forming a sealed pod for storage. The upper shell of the personal motorcraft trailer is hinged along its tail end 28. Moreover, the upper shell is also supported by air filled cylinders 30, which operate in conjunction with the hinge 28 to pivot the upper shell to a raised position.

It will be desirable to provide a rigid protective cover for watercraft, which may be releasably secured to the watercraft without complex and costly mechanical actuation devices. Moreover, it is desirable to have a protective cover which secures to the watercraft without contacting the finished exterior surface of the watercraft.

BRIEF SUMMARY OF THE INVENTION

It is an object of the present invention to provide a simple, rigid protective cover for watercraft, which may be releasably secured to the watercraft without the need for mechanical actuation devices.

It is a further object of the present invention to provide a rigid protective cover having an integrally formed unitary construction which may be manufactured in a cost-effective manner by conventional manufacturing methods.

The present invention is for a removable protective cover for watercraft of the type having a hull with a bow, a stern, and a side periphery. The removable protective cover comprises a rigid upper shell which is adapted to be positioned over the watercraft. Preferably, the rigid upper shell is substantially contoured to the watercraft above a rub rail which is rigidly secured to the side periphery of the hull. The rigid upper shell has nose and tail ends which correspond with the bow and stern respectively. The rigid upper shell also has a peripheral flange which is adapted to be supported by the watercraft. Preferably, the peripheral flange is supported by the rub rail.

The removable protective cover also comprises means for releasably securing the rigid upper shell to the watercraft. Preferably, the means for releasably securing the rigid upper shell to the watercraft includes a hitching element which is connected to the nose end of the rigid upper shell. The hitching element extends below the rub rail to form a hitch cavity seating the bow therein. Additionally, the means for releasably securing the rigid upper shell to the watercraft includes means for releasably securing the tail end of the rigid upper shell upon seating the bow in the hitch cavity. Preferably, where the tail end of the rigid upper shell has an aperture adjacent an anchoring element positioned on the stern, the means for releasably securing the tail end of the rigid upper shell secures to the anchoring element via the aperture at the tail end.

In this manner, the protective cover may be releasably secured to the watercraft by slipping the nose end of the rigid upper shell over the bow of the watercraft. The means for releasably securing the tail end of the rigid upper shell, which is preferably a lock, is then secured to the anchoring element via the aperture.

DESCRIPTION OF THE PREFERRED EMBODIMENTS

Figure 1:
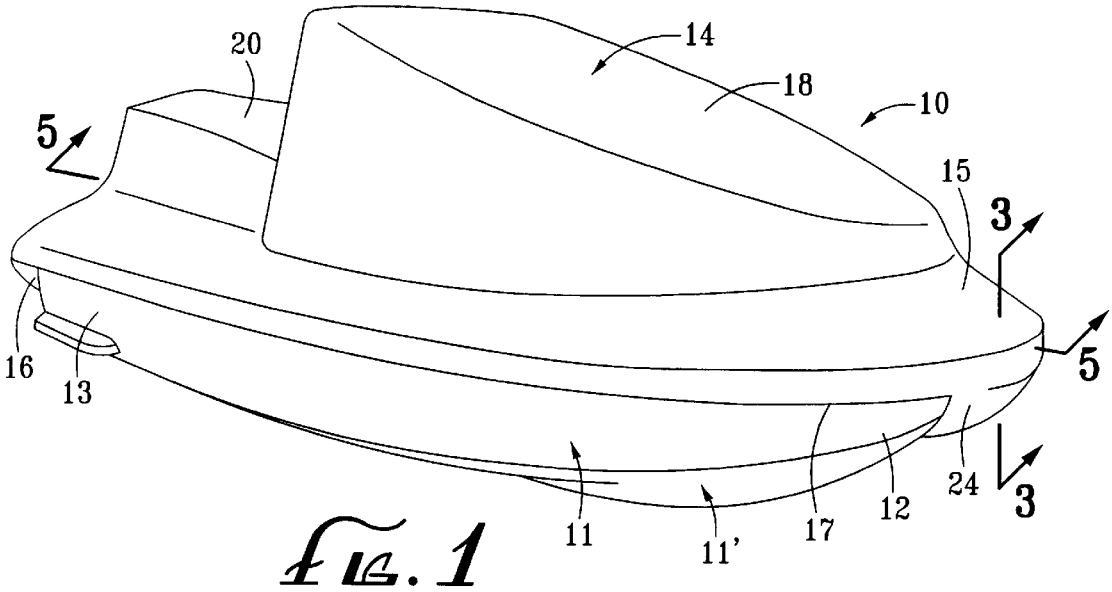
FIG. 1 shows a general perspective view of the protective cover as seen from the nose end and as releasably secured to the watercraft.
Figure 2:
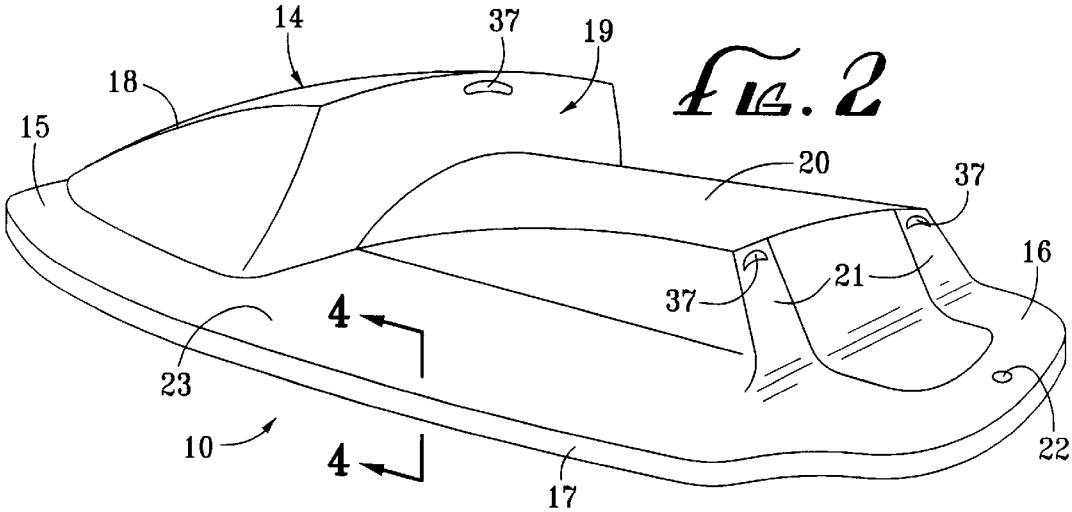
FIG. 2 shows a general perspective view of the protective cover alone as seen from the tail end.
Figure 5:
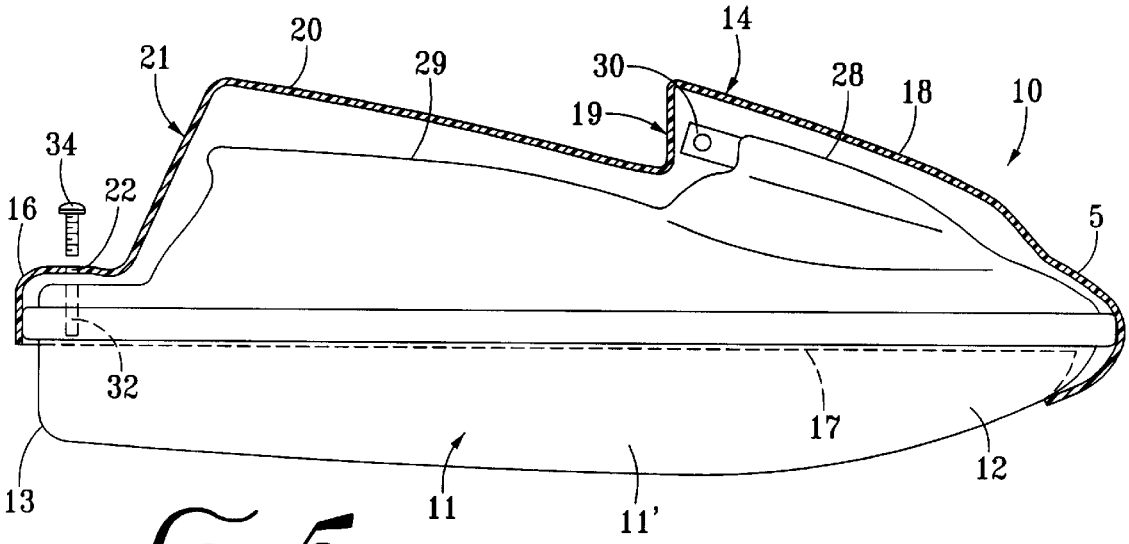
FIG. 5 is a schematic side view of the protective cover as shown in relation to the watercraft.

Referring now to the drawings, FIGS. 1–5 show the protective cover, generally indicated by reference character 10, which may be releasably secured to a watercraft, generally indicated by reference character 11. As can be best seen in FIGS. 2 and 5, the hull 11' has a bow 12 and a stern 13. The protective cover 10 comprises a rigid upper shell, generally indicated by reference character 14. The rigid upper shell 14 has a nose end 15 and a tail end 16, which correspond to the bow 12 and stern 13, respectively. Furthermore, as can be seen in FIG. 5, the rigid upper shell 14 is preferably aerodynamically contoured to the outline of the upper top half of the watercraft 11. In particular, a hood cover portion 18 contouredly covers the hood 28 and handles 30, and a mid-cover portion 20 covers the seat 29. It is notable that the aerodynamic design facilitates transportation by substantially reducing drag. In particular, as can be seen in FIG. 5, the head cover portion 18 preferably slopes upward from the nose end 15 toward the tail end 16, and drops along a back surface 19. Similarly, the mid-cover portion 20 also preferably has a back surface 21, which has a negative slope relative to the direction of air travel around the protective cover. Both back surfaces 19 and 21 operate to produce an area of lower pressure, wherein air vents 37 (shown in FIG. 2) may preferably suction out air from the interior of the cover. As can be seen in FIG. 2, three hooded air vents 37 are shown. One is positioned along the back surface of the hood cover portion 19, and two air vents 37 are positioned along the back surface 21 of the mid-cover portion.

As can be seen in FIGS. 1–2, the rigid upper shell 14 has a shell deck 23 having a peripheral flange 17 extending downward below the shell deck 23. As can be best seen in FIG. 4, the peripheral flange 17 is adapted to be supported by the watercraft 11, and not a secondary support structure, such as a trailer for transporting the watercraft. And preferably, the peripheral flange is adapted to be seated along a rub rail 25 which is itself secured to the hull 11'. In particular, an abutment surface 27 of the peripheral flange 17 contactedly sits along an upper surface 26 of the rub rail 25. In this manner, the removable protective cover 10 preferably contacts and thereby exerts a downward force, only along the rub rail 25 and not along any other exterior surface of the watercraft 11. The rub rail 25 is preferably made of a durable and flexible material, such as plastic or rubber, which is capable of withstanding and supporting a load.

Figure 3:
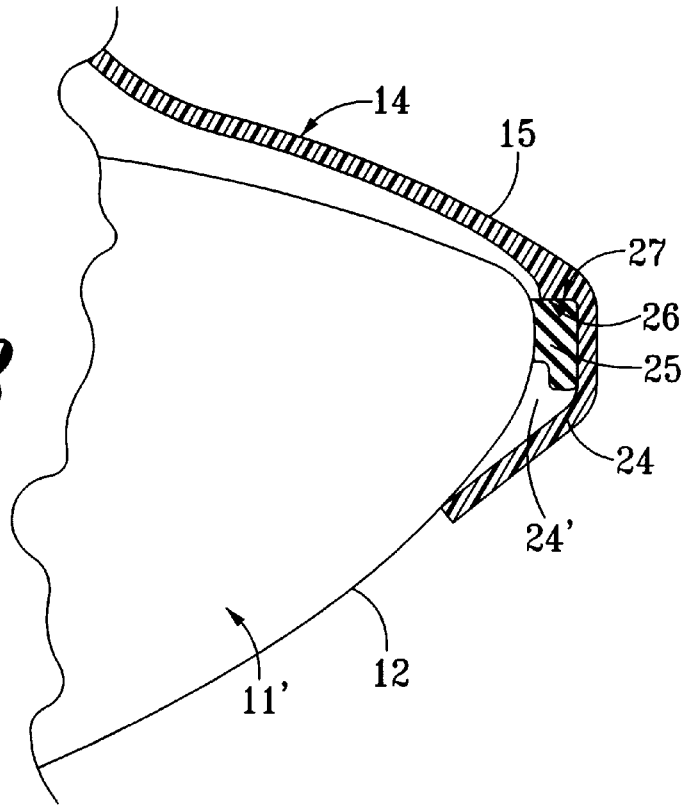
FIG. 3 is a cross-sectional view taken along line 3—3 of FIG. 1.
Figure 4:
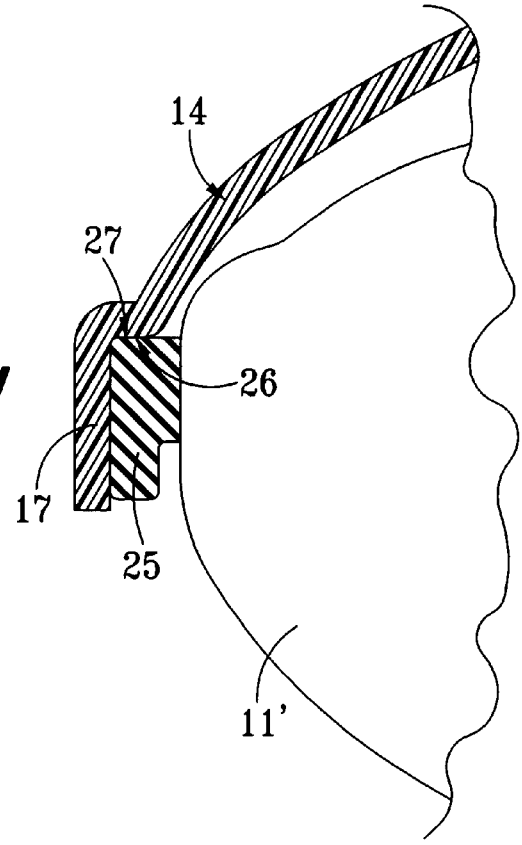
FIG. 4 is a cross-sectional view taken along line 4—4 of FIG. 2, particularly illustrating the contact between the protective cover and the rub rail.

The removable protective cover 11 also has means for releasably securing the rigid upper shell 14 to the watercraft 11. In particular, an important preferred feature of the removable protective cover 10 is a hitching element 24, which is connected to the nose end 15 of the protective cover 10. Preferably, the hitching element 24 is integrally formed with the nose end 15. As can be best seen in FIG. 3, showing a cross-section of the nose end 15 of the protective cover 10, the hitching element 24 extends below the rub rail 25 in a substantially contoured manner relative to the bow 12. The hitching element 24 thus forms a hitching cavity 24' which may receive the bow 12. As can be seen in FIG. 3, the hitching element 24 prevents relative vertical movement of the bow 12 when seated in the hitching cavity 24'. To prevent abrasive contact between the hitching element 24 and the bow 12, a suitable non-abrasive substance or material may be applied therebetween, such as a flexible polymeric foam.

Furthermore, the means for releasably securing the rigid upper shell 14 to the watercraft 11 also comprises means for releasably securing the tail end 16 of the rigid upper shell upon seating the bow 12 in the hitch cavity 24'. As can be seen in FIGS. 2 and 5, the tail end 16 of the rigid shell 14 preferably has an aperture 22 adjacent a locking bore 32 embedded in the stern 13 of the hull 11'. A locking pin 34 is conventionally used for many watercraft models for towing a water skier behind the watercraft 11. In the embodiment shown in FIGS. 2 and 5, the locking pin 34 is releasably securable to the watercraft by partially passing the shank portion of the locking pin 34 through the locking bore 32 such that it may be accessed and secured from below the hull 11'. Moreover, the broad head portion of the locking pin 34 functions to abut and press against the rigid upper shell 14 as the shank portion passes through the aperture 22 and into the locking bore 32, which effectively secures the rigid upper shell 14 to the hull 11'.

Figure 6:
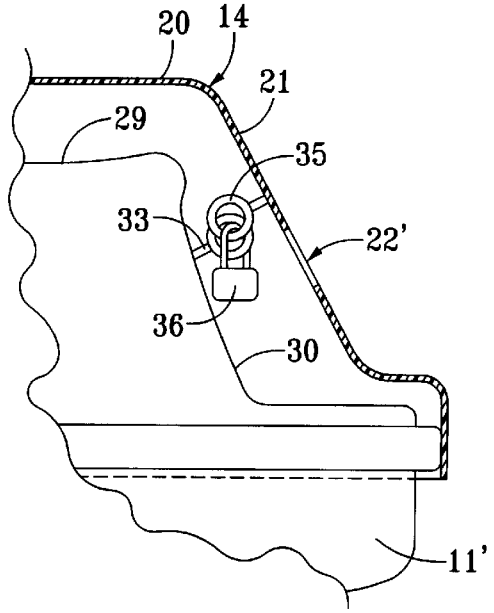
FIG. 6 shows means for releasably securing the cover.

A second embodiment of the means for releasably securing is shown in FIG. 6. In this embodiment, a tow loop 33 is secured to a back surface 30 of the seat 29, and is used for towing a water skier therebehind. Moreover, a tie-down loop 35 is secured to the interior surface of the protective cover 10 adjacent the tow loop 33. An axis aperture 22' is provided along the back surface 21 of the rigid upper shell 14, to enable a user to reach in and releasably secure the tow loop 33 with tie-down loop 35, preferably with a padlock 36. A third alternative embodiment (not shown) utilizes a latch mechanism connected to the rigid upper shell 14 which releasably catches the rub rail 25 at the stern 13 of the watercraft 11 in a manner similar to the hitching element 24.

In this manner, the hitching element 34 preferably operates to prevent removal of the nose end 15 from the bow 12, and the means for releasably securing the tail end 16, preferably operates to secure the tail end 16 after the nose end 15 of the rigid upper shell 14 is seated in the bow 12 of the hitch cavity, for preventing unauthorized or accidental removable of the protective cover 10.

It is notable that the protective cover 10 is preferably composed of a rigid material, such as plastic, fiberglass, or other composite material, which may be easily formed by conventional manufacturing methods. It is also notable that the term "watercraft" is understood and used herein to include various types of boats, jet skis, or other water-based vehicles, as well as other personal motorized and non-motorized craft, such as snowmobiles, etc.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A removable protective cover for watercraft of the type having a hull with a bow, a stern, and a side periphery, said removable protective cover comprising:

a rigid upper shell adapted to be positioned over said watercraft, said rigid upper shell having nose and tail ends corresponding to the bow and stern, respectively, of said hull, and a peripheral flange adapted to be supported by said watercraft; and means for releasably securing said rigid upper shell to said watercraft.

2. The removable protective cover as in claim 1, wherein said peripheral flange of said rigid upper shell is adapted to be supported by a rub rail rigidly secured to said side periphery of said hull.

3. The removable protective cover as in claim 1, wherein said means for releasably securing said rigid upper shell to said watercraft includes a hitching element connected to the nose end of said rigid upper shell and extending below said side periphery to form a hitch cavity for seating the bow therein, and means for releasably securing the tail end of the rigid upper shell upon seating the bow in said hitch cavity.

4. The removable protective cover as in claim 3, wherein said rigid upper shell further includes an aperture located at the tail end thereof, and wherein said means for releasably securing the tail end of the rigid upper shell secures to an anchoring element of the stern via said aperture.

5. The removable protective cover as in claim 3, wherein said hitching element and the nose end of said rigid upper shell are integrally formed to have a unitary construction.

6. The removable protective cover as in claim 1, wherein said rigid upper shell is substantially contoured to said watercraft above said side periphery.

7. The removable protective cover as in claim 1, wherein said rigid upper shell further includes at least one air vent leading into an interior volume of said removable protective cover.

8. The removable protective cover as in claim 7, wherein said at least one air vent is positioned along a corresponding back surface of said rigid upper shell.

9. The removable protective cover as in claim 1, wherein said peripheral flange of said rigid upper shell is adapted to be supported by a rub rail rigidly secured to said side periphery of said hull; and wherein said means for releasably securing said rigid upper shell to said watercraft includes a hitching element connected to the nose end of said rigid upper shell and extending below said side periphery to form a hitch cavity for seating the bow therein, and means for releasably securing the tail end of the rigid upper shell upon seating the bow in said hitch cavity.

10. The removable protective cover as in claim 9, wherein said rigid upper shell further includes an aperture located at the tail end thereof, and wherein said means for releasably securing the tail end of the rigid upper shell secures to an anchoring element of the stern via said aperture.

11. The removable protective cover as in claim 9, wherein said hitching element and the nose end of said rigid upper shell are integrally formed to have a unitary construction.

12. A removable protective cover for watercraft of the type having a hull with a bow, a stern, and a side periphery, said removable protective cover comprising:

a rigid upper shell adapted to be positioned over said watercraft, said rigid upper shell having nose and tail ends corresponding to the bow and stern, respectively, of said hull, and a peripheral flange adapted to be supported by said watercraft; and means for releasably securing said rigid upper shell to said watercraft, said means for releasably securing including a hitching element connected to the nose end of said rigid upper shell and extending below said side periphery to form a hitch cavity for seating the bow therein, and means for releasably securing the tail end of the rigid upper shell upon seating the bow in said hitch cavity.

13. A removable protective cover for watercraft of the type having a hull with a bow, a stern, and a rub rail rigidly secured to a side periphery of said hull, said removable protective cover comprising:

a rigid upper shell adapted to be positioned over said watercraft, said rigid upper shell having nose and tail ends corresponding to the bow and stern, respectively, of said hull, and a peripheral flange adapted to be supported by said rub rail; and means for releasably securing said rigid upper shell to said watercraft.

* * * * *